US005900588A

United States Patent [19]

Springer et al.

[11] Patent Number: 5,900,588

[45] Date of Patent: May 4, 1999

[54] REDUCED SKEW SHIELDED RIBBON CABLE

[75] Inventors: Denis Springer, Austin, Tex.; James H. Voth, New Ulm, Minn.; John W. Benedict, Leander, Tex.

[73] Assignee: Minnesota Mining and Manufacturing Company, Saint Paul, Minn.

[21] Appl. No.: 08/900,653

[22] Filed: Jul. 25, 1997

[51] Int. Cl.[6] ..... H01B 7/08

[52] U.S. Cl. ..... 174/117 F

[58] Field of Search ..... 174/117 F, 117 FF, 174/117 A, 36; 156/51, 52

[56] References Cited

U.S. PATENT DOCUMENTS

| | | | |
|---|---|---|---|
| 4,468,089 | 8/1984 | Brorein | 174/117 F X |
| 4,475,006 | 10/1984 | Olyphant, Jr. | 174/36 |
| 4,533,784 | 8/1985 | Olyphant, Jr. | 174/36 |
| 4,642,480 | 2/1987 | Hughes et al. | 307/147 |
| 4,644,092 | 2/1987 | Gentry | 174/36 |
| 4,645,868 | 2/1987 | Suzuki | 174/117 F |
| 4,649,228 | 3/1987 | Suzuki | 174/36 |
| 4,698,457 | 10/1987 | Bordbar | 174/36 |
| 4,701,576 | 10/1987 | Wada et al. | 174/117 F |
| 4,746,766 | 5/1988 | Soulard | 174/36 |
| 4,835,394 | 5/1989 | Steele | 174/117 F X |
| 4,973,794 | 11/1990 | Steele | 174/117 F X |
| 5,008,488 | 4/1991 | Nakagawa | 174/36 |
| 5,084,594 | 1/1992 | Cady et al. | 174/36 |
| 5,112,419 | 5/1992 | Nakagawa | 156/51 |
| 5,235,132 | 8/1993 | Ainsworth et al. | 174/36 |
| 5,245,134 | 9/1993 | Vana, Jr. et al. | 174/117 F |
| 5,250,127 | 10/1993 | Hara | 156/52 |
| 5,262,589 | 11/1993 | Kesler | 174/36 |
| 5,306,869 | 4/1994 | Springer et al. | 174/36 |
| 5,360,944 | 11/1994 | Springer et al. | 174/117 F |

FOREIGN PATENT DOCUMENTS 0017077 3/1980 European Pat. Off. .

*Primary Examiner*—Kristine Kincaid
*Assistant Examiner*—Chau N. Nguyen
*Attorney, Agent, or Firm*—Matthew B. McNutt

[57] ABSTRACT

A ribbon cable with improved skew control has a plurality of substantially parallel longitudinal conductors lying in a single plane, with insulation encasing the plurality of conductors. The insulation defines first and second outer surfaces which are substantially parallel to the plane of the plurality of conductors. A first sheet of extensible metallic foil is positioned adjacent the first outer surface of the insulation, and a second sheet of extensible metallic foil is positioned adjacent the second outer surface of the insulation. A third sheet of metallic foil is wrapped around substantially all cross-sectional sides of the plurality of conductors, insulation, and first and second sheets of metallic foil to provide a continuous electromagnetic shield around the conductors. A flexible jacket may be provided on the cable to protect the assembly.

20 Claims, 5 Drawing Sheets

REDUCED SKEW SHIELDED RIBBON CABLE

BACKGROUND OF THE INVENTION

The present invention relates generally to shielded ribbon cables, and more particularly to shielded ribbon cables which display improved consistency of electrical properties such as skew.

The requirement for a large capacity of signal distribution in a compact cable has been met with the use of a "ribbon" cable in which a large number of conductors (often 50 or more) lie in a single plane and are encased in a common insulating material. The ribbon cable provides many signal conductors in a compact cable while affording ease of terminability with mass termination equipment.

Electrical cables, especially those cables used for high speed data transmission, are extremely sensitive to changes in their electromagnetic environment. Changes or discontinuities in the electromagnetic environment of a cable may cause electrical properties of the cable to vary, such as the speed with which an electrical signal propagates through a conductor. In multiple conductor ribbon cables, such variation of electrical properties causes undesired results, including skewing of electrical signals. In addition to skewing in cables having a relatively large number of conductors, it should be noted that discontinuities in the electromagnetic environment of a cable having only a few conductors are also problematic, and the invention described herein is equally applicable to cables having only a few conductors.

Skew is defined as the difference in arrival time of pulses at the far end of a cable when the pulses are simultaneously launched from the near end of the cable. Typical unshielded flat ribbon cables will have skew ranging from about 10 to 20% of the total propagation time. Shielded cables, which utilize metallic, i.e., highly conductive, materials to shield the conductors will typically have skew of about 5 to 10%. The reduced skew of shielded cables is a result of the cable shielding stabilizing the electromagnetic environment of the cable conductors. The shielding allows the conductors in the cable to experience a uniform electromagnetic environment, and thus to exhibit uniform electrical properties.

The property of skew is important in digital signal transmission. For example, if signal pulses are simultaneously launched along parallel conductors at the near end of a ribbon cable, system designers want all of the pulses to arrive at the far end of the cable within a maximum time of about 25% of the total pulse length. To achieve this requirement, system designers are currently forced to restrict the maximum cable length or to use cables with more transmission speed consistency. As signal speeds increase (i.e., the signal pulses become shorter in duration and closer together in time), the consistency of the cable transmission speed becomes very important.

In the past, when interconnections which had low skew were required, it was common to cut individual signal paths to a specific electric length. Consider, for example, a system requiring a 40 foot path and using a pulse length of 1600 picoseconds. The maximum acceptable variation of pulse arrival time is 400 picoseconds (25% of the 1600 picosecond pulse length). If the propagation velocity of the pulse in the cable is 1500 picoseconds/foot, the control accuracy required is:

$$\frac{400 \text{ picoseconds}}{1500 \text{ picoseconds}/\text{ft} \times 40 \text{ ft}} \times 100\% = 0.67\%$$

If multiple conductors are to be cut to length with this accuracy, the length of each conductor must be cut within 3.2 inches (0.67% of 40 feet) to meet the control accuracy requirements, assuming there is no electrical variation in the conductors.

In this example, ribbon cables have a distinct advantage over single conductor cables because the multiple conductors in a ribbon cable can easily be cut to length with a variation of less than 0.5 inches. In contrast, individual conductors that are 40 feet long may stretch several inches depending upon how much tension the conductors are placed under during measuring and cutting, thereby increasing the difficulty of cutting the conductors to a consistent length.

Although ribbon cables greatly increase the ease of cutting multiple conductors to a uniform length, the multiple conductors of the ribbon cable must also exhibit electrical uniformity to provide the desired control accuracy. To achieve satisfactory electrical uniformity in a cable, several relevant physical properties of the cable must be very carefully controlled. Factors that are important for controlling electrical uniformity are the dielectric constant of the cable insulation, the distance between the electromagnetic shielding and the individual conductors, and the relative quantities of the various dielectric materials in the cable.

U.S. Pat. Nos. 4,475,006 and 4,533,784, each assigned to Minnesota Mining and Manufacturing, the assignee of the present application, disclose shielded ribbon cables and means for controlling electrical properties in ribbon cables. U.S. Pat. No. 4,475,006 discloses a flexible ribbon cable having a plurality of conductors lying in a single plane and surrounded by insulation. The outer surface of the insulation is flat on both sides of the cable, and there is a sheet conductor (typically a metal foil) adhesively bonded to the surface of the insulation about the entire circumference of the cable. The sheet conductor is cigarette-wrapped along the length of the cable with an overlap at the seam of the cigarette wrap. Alternatively, separate layers of the sheet conductor are placed on each major surface of the cable, with the two shield layers overlapping and contacting at the edges of the cable.

U.S. Pat. No. 4,533,784, discloses a shielded ribbon cable having an extensible electromagnetic shield. Sometimes referred to as a pleated foil cable (PFC), the cable shield has multiple pleats which are transverse to the conductors, such that the shield has improved flexibility to reliably maintain integrity of the shield. Like the cable in U.S. Pat. No. 4,475,006, the shield is cigarette-wrapped about the cable insulation.

The cable construction of U.S. Pat. Nos. 4,475,006 and 4,533,784 provides works well and provides substantial improvement over conventional cables. Typically, cables made as described in of U.S. Pat. Nos. 4,475,006 and 4,533,784 have skew control of about 2.5% consistently, as compared to other shielded cables which provide skew control of 5 to 10%. However, in the example given above, a skew control of 0.67% was required. Thus, the skew control of cables having the construction described in U.S. Pat. Nos. 4,475,006 and 4,533,784 is inadequate for many modern system designs. To meet the requirements set out in the example, the skew control must be reduced by a factor of four (to provide skew of less than 0.67%). Or else the maximum cable length must be restricted to 10 feet (¼ of 40 feet).

Prior art ribbon cables have not provided adequate skew control for modern electrical systems. What is needed is a ribbon cable which provides improved electrical consistency, and in particular a ribbon cable which provides improved skew control to meet the more demanding requirements of digital signal transmission.

SUMMARY OF THE INVENTION

The present invention is a ribbon cable construction that provides improved skew control. The flexible cable comprises a plurality of substantially parallel longitudinal conductors lying in a single plane, with insulation encasing the plurality of conductors. The insulation defines first and second outer surfaces which are substantially parallel to the plane of the plurality of conductors. A first sheet of metallic foil is positioned adjacent the first outer surface of the insulation, and a second sheet of metallic foil is positioned adjacent the second outer surface of the insulation. The first and second sheets of metallic foil are brought into electrical contact with each other by a third sheet of metallic foil which is wrapped around substantially all cross-sectional sides of the plurality of conductors, insulation, and first and second sheets of metallic foil. The present invention thus provides a highly flexible ribbon cable with excellent skew control. The inventive ribbon cable eliminates variation of the shield to conductor distance, provides a cable with uniform thickness across its width, and eliminates sharp bends at the cable sides in the continuous foil sheets which may affect the propagation delay of the conductors near the bends.

DETAILED DESCRIPTION OF THE INVENTION

The invention is described below with reference to the Figures. In the Figures, like elements are identically numbered for ease of identification.

Figure 1:
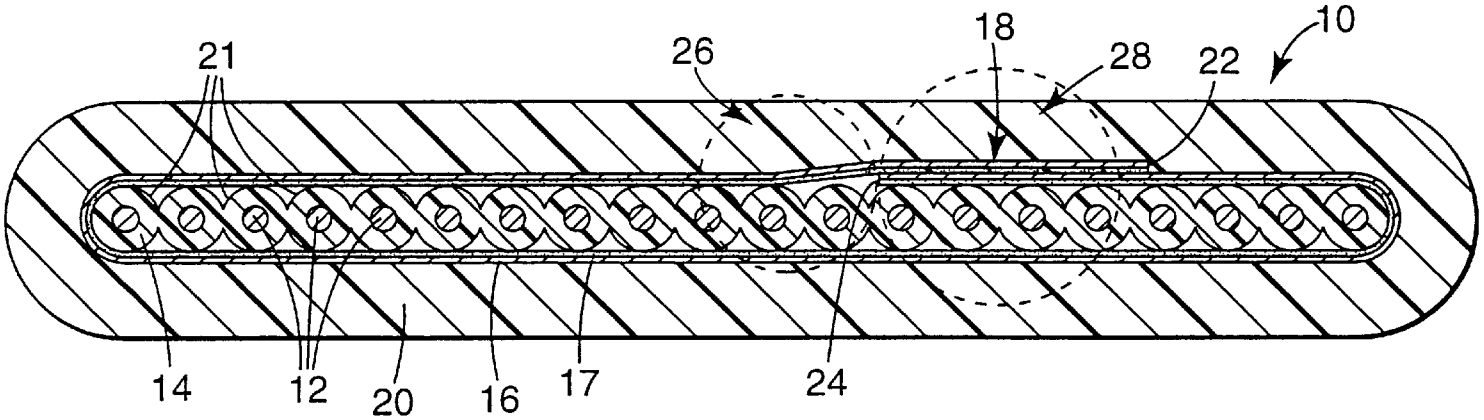
Fig. 1 Prior Art
FIG. 1 is a cross-sectional view of a prior art cable construction.

FIG. 1 shows a prior art construction of a shielded ribbon cable 10. Examples of such a ribbon cable are sold by Minnesota Mining and Manufacturing Company under the designations PFC 90101 and PFC 90201. Ribbon cable 10 includes multiple conductors 12 lying in a single plane and encased by insulating material 14. The insulating material 14 is preferably a material such as polyurethane, polyethylene, polypropylene, tetrafluoroethylene, fluorinated ethylene propylene, EPDM rubber or EP rubber.

Conductors 12 and insulating material 14 are surrounded by foil 16, which is a highly conductive metallic foil. As used herein, the terms "shield" and "foil" are interchangeable. Foil 16 is "cigarette-wrapped" along the length of insulating material 14, such that an overlap 18 is created at the seam of the cigarette wrap to provide electrical continuity about the entire circumference of insulating material 14. Foil 16 is bonded by adhesive 17 to insulating material 14 to provide intimate contact between foil 16 and insulating material 14. The assembly of conductors 12, insulating material 14 and foil 16 is encased in a protective jacket 20.

It will be noted that insulating material 14 in each of the Figures is formed with ridges 21. While it is desirable electrically to have a cable insulating material 14 that is flat on both sides, such a cable is difficult to terminate, because it is difficult to accurately determine the position of conductors 12 within insulating material 14. Accordingly, ridges 21 are preferably formed in insulating material 14. Ridges 21 correspond to the position of conductors 12 and dramatically improve convenience when terminating a cable to connectors or circuit boards. When it is desired to terminate a cable, projective jackets and shielding are stripped away from insulating material 14 and ridges 21 easily identify the location of conductors 12. Ridges 21, however, lead to increased variation in effective dielectric constant of the cable as ridges 21 allow an additional dielectric (air) into the cable and a location for adhesive to move. As the effective dielectric constant of the cable varies across the cable, the propagation speed of signals traveling through conductors 12 is affected, resulting in skew.

In cable constructions like that illustrated in FIG. 1, there are two factors which have a large effect on the skew exhibited by cable 10. The first factor is the method of applying the metal foil 16 about insulating material 14. When foil 16 is applied by wrapping the foil in "cigarette fashion" about cable 10, a discontinuity in the electromagnetic environment of cable 10 is created in the overlapped area 18. Specifically, when upper layer 22 of foil 16 is positioned over lower layer 24 of foil 16 coming from the other side of the cable, there is an area 26 across cable 10 where the shield to conductor distance varies. As the shield to conductor distance varies in area 26, electrical properties (such as signal propagation speed) of conductors 12 in area 26 also vary.

In addition to the varying conductor to shield distance in area 26, there is also an increase in the amount of air in the cable package in area 26. The space between foil 16 and insulating material 14 in area 26 is generally filled by air, which decreases the effective dielectric constant in the immediate vicinity. The effect of the increased conductor to shield distance and increased amount of air in area 26 is to cause the dielectric constant to decrease and the propagation velocity to increase for the wire or wires immediately under this transition, thereby resulting in skewing of signals traveling through conductors 12.

Further increasing the skewing exhibited by cable 10 of FIG. 1 is the double layer of foil 16 and adhesive 17 in area 28. The additional layers of foil 16 and adhesive 17 cause area 28 of cable 10 to be thicker than the balance of cable 10. When cable 10 is processed through nip rollers, which is often necessary in either dispensing the finished cable or in the manufacture of the cable, this extra thickness in area 28 increases the compressive forces exerted on cable 10 in the area of the overlap 18. These compressive forces tend to compact area 28 of cable 10 to a greater degree than the rest of cable 10, and force air out of cable 10. Forcing air out of cable 10 causes the effective dielectric constant in area 28 to increase, which in turn decreases the propagation velocity of conductors 12 adjacent area 28. Thus, conductors 12 adjacent area 26 have an increased propagation speed, and conductors adjacent area 28 have a decreased propagation speed. While such variation in propagation speed across cable 10 is acceptable in many applications, there are also many instances where a greater degree of skew control is required.

Figure 2:
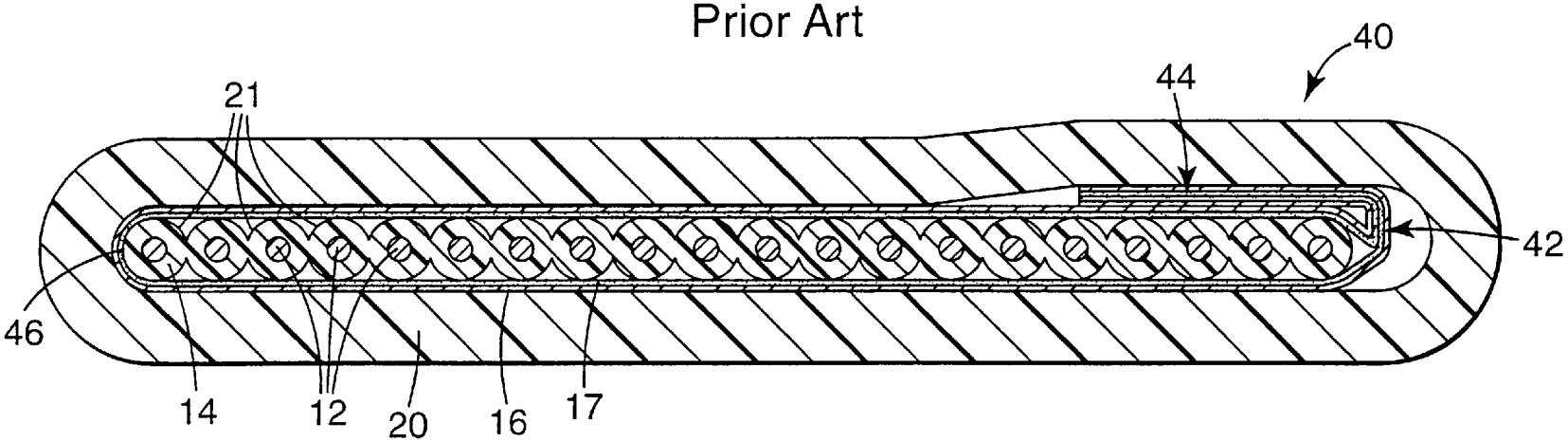
Fig. 2 Prior Art
FIG. 2 is a cross-sectional view of another prior art cable construction.

FIG. 2 shows a cable 40 which improves the skew control of cable 10 in FIG. 1 by moving joint 42 of foil 16 to a side of the cable. The cable construction of FIG. 2 thus improves the skew control by eliminating the "transition" phenomenon (varying shield to conductor distance and increased air in the cable) exhibited in area 26 of cable 10 in FIG. 1. However, the "overlapping" phenomenon as described for area 28 of cable 10 in FIG. 1 is worsened because there are now four additional layers over portion 44 of cable 40 (two layers of foil 16 and two layers of adhesive 17) rather than two additional layers as in the cable construction of FIG. 1.

Testing of the cable construction of FIG. 2 shows that the skew in cable 40 comes primarily from two regions of cable 40. The first region of cable 40 which exhibits skew is the area of overlap 44 as described above. As with cable 10 of FIG. 1, the extra layers of foil 16 and adhesive 17 cause air to be forced out of the cable assembly during processing or manufacturing, thereby increasing the dielectric constant in the vicinity of overlap 44 and decreasing the propagation speed of conductors 12 in that area. The second region of cable 40 which exhibits skew is adjacent edge 46 (the left side of the cable as drawn in FIG. 2). As foil 16 wraps around edge 46 of cable 40, conductors 12 adjacent edge 46 experience a change in the propagation speed of conductors 12 adjacent edge 46. The first conductor adjacent edge 46 has an increased propagation delay, and the next two to three conductors have a lesser propagation delay. Testing of cable 40 indicates that the strength of foil 16 in bending could overhaul the strength of adhesive 17 and cause a change in the effective dielectric constant in areas where foil 16 and adhesive 17 undergo sharp bends. It should be noted that this same "edge" phenomenon is also present in cable 10 of FIG. 1, but its effect is small in comparison to the changes in propagation speed in areas 26 and 28 of FIG. 1. Only as the total cable skew decreases does the edge phenomenon become the primary contributor to skew. The cable construction of FIG. 2 results in a cable which has a control of skew of approximately 1.5%, a significant improvement over the cable construction of FIG. 1.

Figure 3:
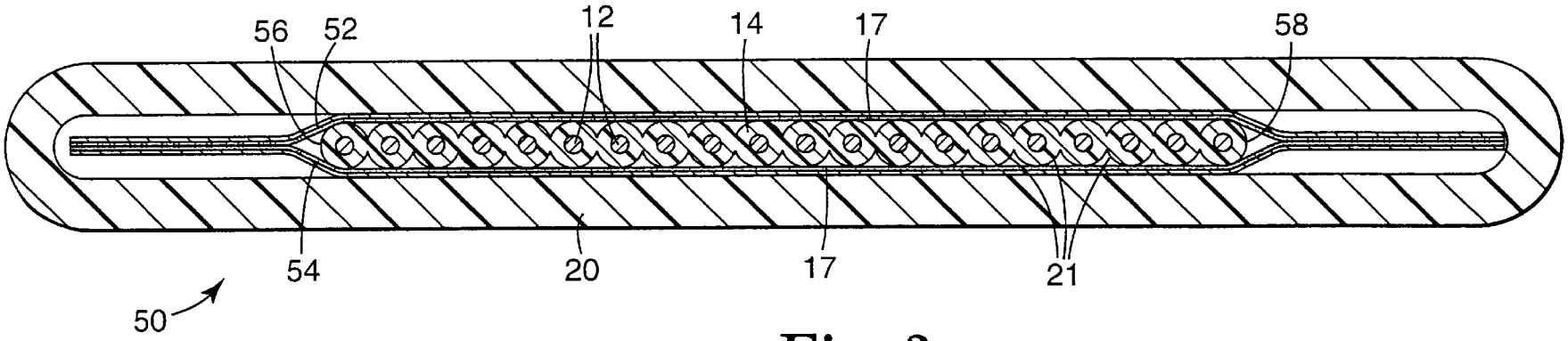
Fig. 3 Prior Art
FIG. 3 is a cross-sectional view of yet another prior art cable construction.

FIG. 3 shows an alternative cable 50 which sandwiches conductors 12 and insulating material 14 between a first sheet of foil 52 and a second sheet of foil 54. Foil sheets 52, 54 extend beyond edges 56, 58 of insulating material 14, such that sheets 52, 54 may be joined to completely enclose conductors 12 and insulating material 14. First and second foil sheets 52, 54 are bonded to insulating material 14 and to each other with adhesive 17. The construction of cable 50 eliminates any overlapping of foil sheets 52, 54 such that multiple layer changes (as are present in cables 10 and 40 of FIGS. 1 and 2, respectively) are avoided, as are tight bends of foil sheets 52, 54 which may affect the dielectric constant of the edge conductors of cable 50. However, cable 50 suffers from the fact that the overall width of cable 50 is greatly increased over the width of cables 10 and 40 in FIGS. 1 and 2, respectively. The construction of cable 50 does meet the stringent skew requirements of the example given above but at the cost of a larger cable which is often unacceptable in systems where compactness is required.

Figure 4:
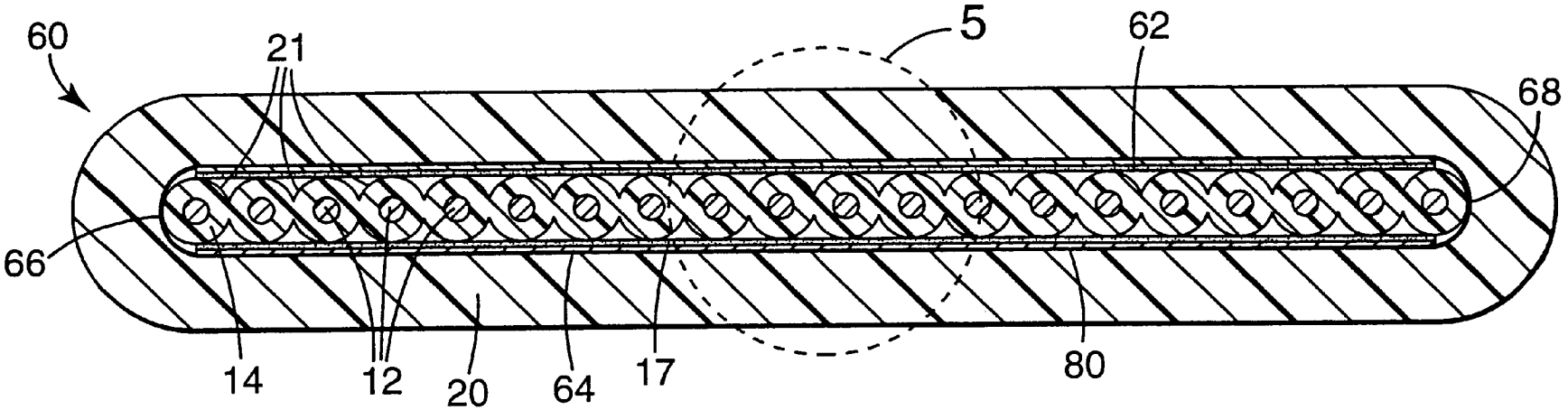
FIG. 4 is a cross-sectional view of the inventive cable construction.
Figure 5:
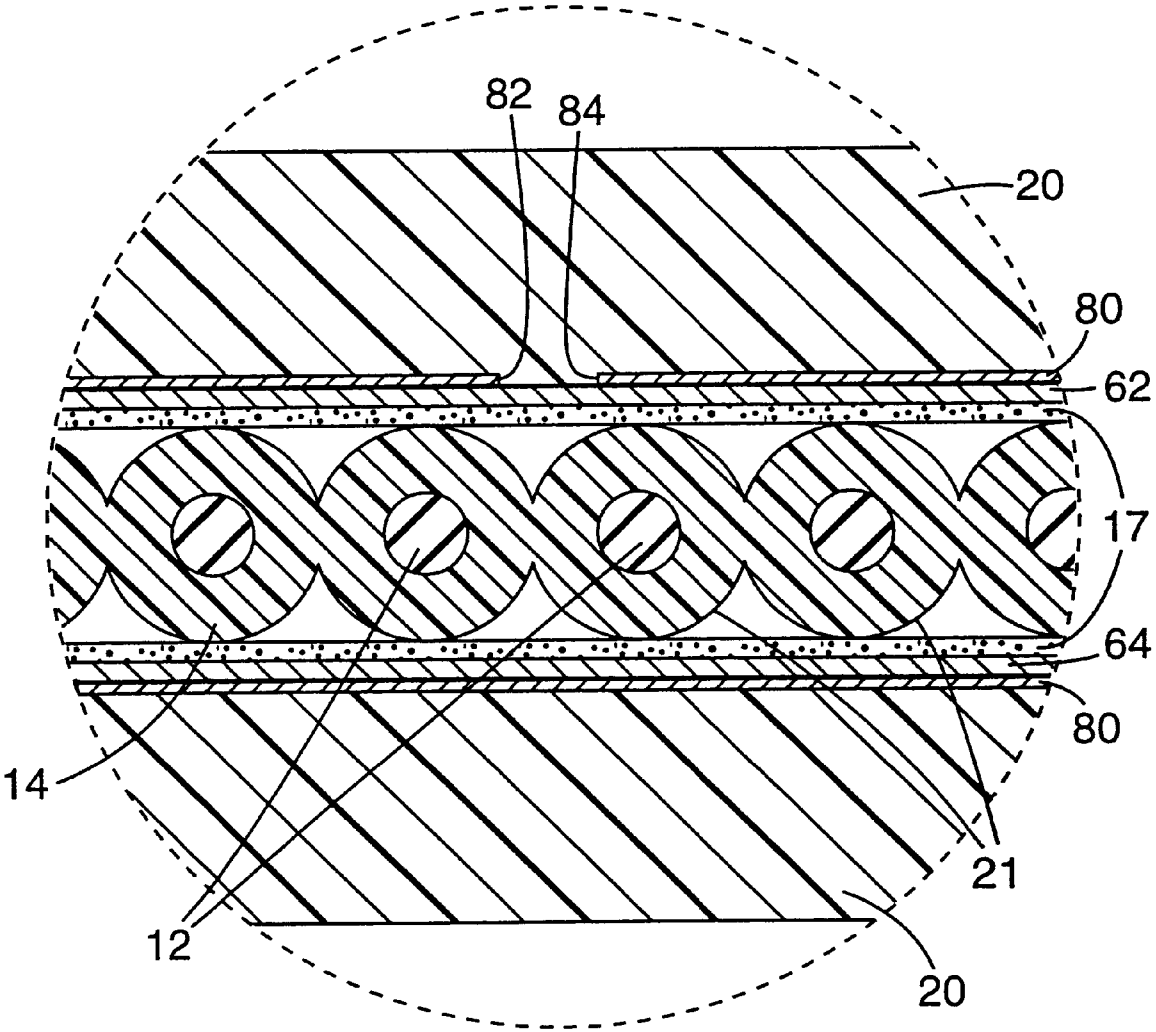
FIG. 5 is an enlarged cross-sectional view of a portion of the cable construction of FIG. 4.

The inventive cable 60 is shown in FIGS. 4 and 5. FIG. 5 shows circled portion 5 of FIG. 4 in greatly enlarged detail. In the inventive construction, conductors 12 and insulating material 14 are laminated between two sheets of extensible foil 62, 64. Sheets 62, 64 are bonded to insulating material 14 with adhesive 17. Unlike foil sheets 52, 54 of cable 50 in FIG. 3, foil sheets 62, 64 of inventive cable 60 do not extend beyond edges 66, 68 of insulating material 14. In this manner, foil sheets 62, 64 are completely independent of each other; foil sheets 62, 64 do not interact with each other during bending of cable 60 and the entire width of each foil sheet 62, 64 sees approximately the same bending forces. In contrast, in the cables of FIGS. 1 and 2, bending forces within foil 16 are variable because of geometrical differences from one side of the cable to the other side. As noted above, in some instances the bending forces may cause discontinuities in the effective dielectric constant of the conductors and cause skewing in the cable. It is therefor desirable to maintain uniform bending stresses throughout the foil sheets 62, 64, and to avoid sharp bends in sheets 62, 64.

Figure 6:
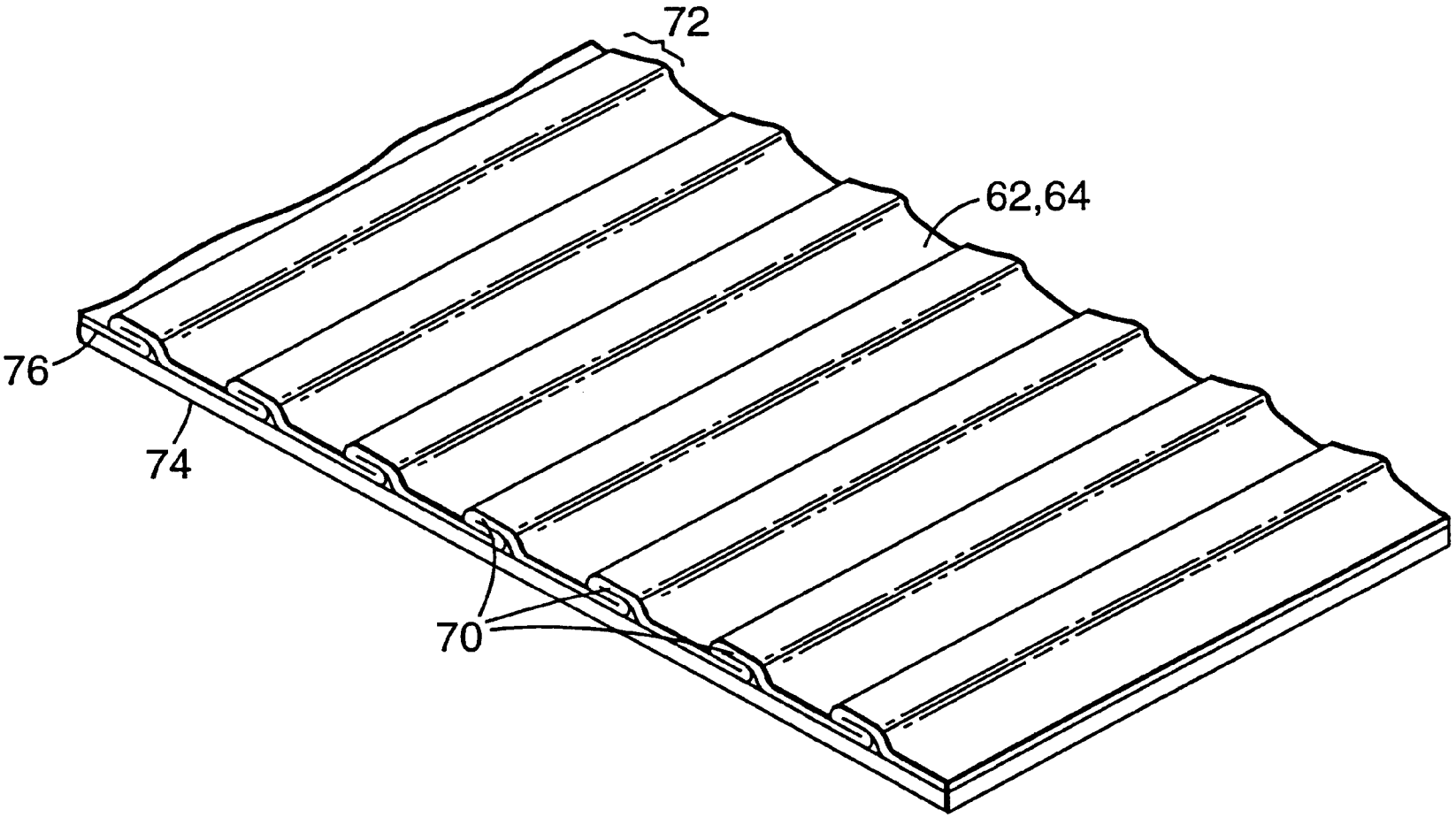
FIG. 6 is an isometric view of the metallic foil used in the inventive cable construction.

Foil sheets 62, 64 preferably have a thickness of between one-half mil and two mils, and are preferably pleated foil, as disclosed in U.S. Pat. No. 4,533,784, owned by the assignee of the present application, and incorporated herein by reference. Such a pleated foil sheet is less susceptible to damage when cable 60 is subjected to bending and tensile forces. As illustrated in FIG. 6, it can been seen that foil sheets 62, 64 have a plurality of transverse folds 70 which are flattened to form an area of overlap 72. The resulting pleated foil may have a longitudinal extension of from 15 percent to 100 percent of its nonextended length. The foil may also contain a liner 74 bonded to the flattened foil with an adhesive 76. Such a foil exhibits non-linear yield behavior on the application of longitudinal force. With the longitudinal force below a nominal yield value, the pleated foil acts as a continuous foil with a minimal amount of longitudinal extension and generally will return to near its original position upon the removal of that longitudinal force. With the application of a longitudinal force above the nominal yield amount, the pleated foil extends quite freely.

Because foil sheets 62, 64 are independent of each other and do not completely surround conductors 12 and insulating material 14, a third sheet of foil 80 is wrapped about the package to electrically connect sheets 62, 64 and eliminate EMI emission and susceptibility on the edges 66, 68 of cable 60. Foil sheets 62, 64, 80 are preferably copper or aluminum. Foil sheet 80 does not need to be a pleated foil, although it may be. The width of the third foil sheet 80 is carefully selected so that there is no overlap of the foil ends 82, 84 (best seen in FIG. 5) and so that the gap between the ends 82, 84 is less than the width of a single conductor 12. By controlling the dimension of the gap between ends 82, 84 of foil sheet 80, the thickness of cable 60 is kept constant except for the small gap between the foil ends 82, 84 which is of no consequence in the inventive design.

The combination of conductors 12, insulating material 14, and three sheet of foil 62, 64, 80 is encased by a jacket or cover 20 which holds the third layer of foil 80 in the desired orientation. The inventive cable construction is capable of achieving 1.0% control of skew routinely and typically can be as good as 0.5% if the shape and thickness of the cable is carefully controlled.

The inventive cable as disclosed above has several advantages over prior art ribbon cables. The inventive cable controls variation of the shield to conductor distance, provides a cable with uniform thickness across its width, and eliminates sharp bends in the continuous foil sheets which may affect the effective dielectric constant of the conductors. Each of these items has the effect of creating uniform electrical properties across the cable, and specifically has the effect of greatly increasing the skew control of the cable.

Thus, it can be seen that there has been shown and described a novel cable for providing improved skew control. It is to be understood, however, that various changes, modifications, and substitutions in the form of the details of the present invention can be made by those skilled in the art without departing from the scope of the invention as defined by the following claims.

What is claimed is:

1. A flexible ribbon cable comprising:

a plurality of substantially parallel longitudinal conductors lying in a single plane;

insulation encasing the plurality of conductors, the insulation defining first and second outer surfaces substantially parallel to the plane of the plurality of conductors;

a first sheet of metallic foil positioned adjacent the first outer surface of the insulation;

a second sheet of metallic foil positioned adjacent the second outer surface of the insulation, the second sheet physically separated from the first sheet; and a third sheet of metallic foil extending around substantially all cross-sectional sides of the plurality of conductors, insulation, and first and second sheets of metallic foil.

2. The ribbon cable of claim 1, wherein the first, second and third sheets of metallic foil each comprises a continuous metallic foil.

3. The ribbon cable of claim 1, wherein the first and second sheets of metallic foil each comprises a continuous metallic foil having a plurality of flattened transverse folds forming a plurality of transverse overlaps.

4. The ribbon cable of claim 1, further comprising a flexible protective jacket surrounding the plurality of conductors, insulation, and first, second and third sheets of metallic foil.

5. The ribbon cable of claim 1, further comprising a securing means coupling the first and second sheets of metallic foil to the insulation.

6. The ribbon cable of claim 5, wherein the securing means comprises an adhesive intimately bonding the first and second sheets of metallic foil to the first and second outer surfaces, respectively, of the insulation.

7. The ribbon cable of claim 1, wherein the first, second and third metallic sheets are strippable from the insulation such that removal of the metallic sheets may be effected where desirable to terminate the cable.

8. The ribbon cable of claim 1, wherein the insulation is a material selected from the group consisting of polyurethane, polyethylene, polypropylene, tetrafluoroethylene, fluorinated ethylene propylene, EPDM rubber and EP rubber.

9. The ribbon cable of claim 1, wherein the insulation has at least one of the first and second outer surfaces ridged longitudinally with the ridges corresponding to the plurality of conductors.

10. The ribbon cable of claim 1, wherein the thickness of the first and second sheets of metallic foil is between one-half mil and two mils.

11. The ribbon cable of claim 1, wherein the first, second and third sheets of metallic foil are constructed from a material selected from the group consisting of copper and aluminum.

12. An electrical cable comprising:

at least one longitudinal conductor;

insulation encasing the at least one conductor, the insulation defining first and second outer surfaces;

a first sheet of metallic foil positioned adjacent the first outer surface of the insulation;

a second sheet of metallic foil positioned adjacent the second outer surface of the insulation, the second sheet physically separated from the first sheet; and a third sheet of metallic foil extending around substantially all cross-sectional sides of the at least one conductor, insulation, and first and second sheets of metallic foil.

13. The electrical cable of claim 12, wherein the first, second and third sheets of metallic foil each comprises a continuous metallic foil.

14. The electrical cable of claim 12, wherein the first and second sheets of metallic foil each comprises a continuous metallic foil having a plurality of flattened transverse folds forming a plurality of transverse overlaps.

15. The electrical cable of claim 12, further comprising a flexible protective jacket surrounding the plurality of conductors, insulation, and first, second and third sheets of metallic foil.

16. The electrical cable of claim 12, further comprising a securing means coupling the first and second sheets of metallic foil to the insulation.

17. The electrical cable of claim 16, wherein the securing means comprises an adhesive intimately bonding the first and second sheets of metallic foil to the first and second outer surfaces, respectively, of the insulation.

18. The electrical cable of claim 12, wherein the first, second and third metallic sheets are strippable from the insulation such that removal of the metallic sheets may be effected where desirable to terminate the cable.

19. The electrical cable of claim 12, wherein the insulation is a material selected from the group consisting of polyurethane, polyethylene, polypropylene, tetrafluoroethylene, fluorinated ethylene propylene, EPDM rubber and EP rubber.

20. The electric cable of claim 12, wherein the thickness of the first and second sheets of metallic foil is between one-half mil and two mils.

* * * * *